US006923934B2

(12) United States Patent
Nishikiori

(10) Patent No.: US 6,923,934 B2
(45) Date of Patent: Aug. 2, 2005

(54) TITANIUM ALUMINIDE, CAST MADE THEREFROM AND METHOD OF MAKING THE SAME

(75) Inventor: Sadao Nishikiori, Tokyo (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 112 days.

(21) Appl. No.: 10/213,493

(22) Filed: Aug. 6, 2002

(65) Prior Publication Data

US 2002/0195174 A1 Dec. 26, 2002

Related U.S. Application Data

(62) Division of application No. 09/587,958, filed on Jun. 6, 2000, now abandoned.

(30) Foreign Application Priority Data

Jun. 8, 1999 (JP) ..... 11-161073

(51) Int. Cl.[7] ..... C22C 14/00

(52) U.S. Cl. ..... 420/418; 148/422; 148/671; 148/691; 148/442

(58) Field of Search ..... 420/418, 552; 148/422, 671, 691, 694

(56) References Cited

U.S. PATENT DOCUMENTS

| | | | |
|---|---|---|---|
| 2,880,087 A | 3/1959 | Jaffee | |
| 5,286,443 A | 2/1994 | Nazmy | |
| 5,350,466 A | 9/1994 | Larsen, Jr. et al. | |
| 5,429,796 A | 7/1995 | Larsen, Jr. | |
| 5,624,505 A | 4/1997 | Mazur et al. | |
| 5,839,504 A | 11/1998 | Matsuda | |

FOREIGN PATENT DOCUMENTS

| | | | | |
|---|---|---|---|---|
| EP | 0469525 A1 | | 2/1992 | |
| JP | 01298127 A | | 12/1989 | |
| JP | 03219034 A | | 9/1991 | |
| JP | 03219147 A | | 9/1991 | |
| JP | 04285138 A | | 10/1992 | |
| JP | 05070912 A | | 3/1993 | |
| JP | 05070912 A | * | 3/1993 | ..... C22F/1/18 |
| JP | 0511995 A | | 5/1993 | |
| JP | 05178664 A | | 7/1993 | |

OTHER PUBLICATIONS

Kim, M.C. et al: "Composition and growth rate effects in directionally solidified TiAl alloys", Material Science and Engineering, (1997), A239–240, pp. 570–576.

Kimura, M. et al: "Study on phase stability in Ti–Al–X systems at high temperatures", Material Science and Engineering, (1992), A152, pp. 54–59.

Singh, A.K. et al: "Transforamtions in ox2 + y Titanium Aluminide Alloys Containing Molybdenum: Part I. Solidification Behavior", Metallurgical and Materials Transactions A, (1997), 28A, pp. 1735–1743.

(Continued)

*Primary Examiner*—Daniel J. Jenkins
(74) *Attorney, Agent, or Firm*—McCormick, Paulding & Huber LLP

(57) ABSTRACT

TiAl alloy includes 46 to 50 at % of Al, 5 at % or less of combination of Mo, V and Si, provided that Si content is 0.7 at % or less, and Mo content satisfies an equation of −0.3x +17.5 at % or less where x represents Al (at %), and the remainder being Ti and inevitable impurities. Mo may be replaced by Fe or combination of Mo and Fe. TiAl alloy is heated to a melt, poured into a mold, and cooled at a rate of 150 to 250° C./min within a temperature range of 1500 to 1100° C. The resulting product can be used as cast. If desired, however, heat treatment such as HIP or homogenization may be performed within a temperature range of 1100 to 800° C. After the heat treatment, the melt is cooled at a rate of 100° C./min or more until room temperature.

27 Claims, 8 Drawing Sheets

OTHER PUBLICATIONS

Singh, A.K. et al: "Transformations in ox2 + y Titanium Aluminide Alloys Containing Molybdenum: Part II. Heat Treatment", Metallurgical and Materials Transactions A, (1997), 28A, pp. 1745–1753.

Knippscheer, S. et al: "Intermetallic TiAl (Cr,Mo,Si) Alloys for Lightweight Engine Parts. Structure, Properties and Applications", Advanced Engineering Materials, (1999) 1,3–4, pp. 187–191.

* cited by examiner

TITANIUM ALUMINIDE, CAST MADE THEREFROM AND METHOD OF MAKING THE SAME

This application is a Divisional Application of U.S. Ser. No. 09/587,958, now abandoned, entitled 'Titanium Aluminide, Cast Made Therefrom and Method of Making the Same', Sadao Nishikiori, filed on Jun. 6, 2000, and claims the benefit of the filing date thereof under 35 U.S.C. §120.

BACKGROUND OF THE INVENTION

1. Field of the Invention

The present invention generally relates to titanium aluminide, cast (or mechanical part) made from the titanium aluminide, and method of making the cast, and more particularly relates to those used in manufacture of mechanical parts of a turbocharger mounted on a diesel engine operating under an elevated temperature for a long period.

2. Description of the Related Art

Titanium aluminide is an alloy of Al and Ti. Because of its characteristics such as lightweight and high strength, TiAl is commonly used in rotating parts of jet engines and automobile engines. When TiAl is used in mechanical parts of a vehicle such as parts of a turbocharger of a diesel engine, which are subjected to a very high temperature for a considerable time of period, however, additional considerations and improvements are needed in terms of mass productivity, cost effectiveness, creep resistance, oxidation resistance, etc. Specifically, mechanical parts made from conventional TiAl are mostly fabricated by forging, but the forging process is not suited for mass production. Since automobiles are made in a large number, it is not practical to manufacture the parts of the turbocharger by the forging process.

In the meantime, it is known that the creep resistance can be improved by adding third and/or fourth element such as W, Ta, Nb and Cr. However, addition of the third/fourth element would greatly degrade precision castability. The mechanical parts of the engine should often be made by precision casting. It is also known that the creep resistance can be raised by forging if the forging is performed in a manner to control the structure. However, this requires complicated heat treatment, which in turn results in raised cost.

Further, the conventional TiAl is poor in oxidation resistance under high temperature. Specifically, the surface of the product is oxidized if the surrounding temperature exceeds 700° C., and the resulting scale peels off. Accordingly, the product made from the conventional TiAl cannot be used for the turbocharger or the like that is designed to operate in an environment over 700° C.

SUMMARY OF THE INVENTION

An object of the present invention is to provide TiAl that possesses mass productivity, improved creep resistance and improved oxidation resistance while maintaining preferred characteristics the above-mentioned conventional TiAl already has.

Another object of the present invention is to provide a product cast from such TiAl.

Still another object of the present invention is to provide a method of making such product.

According to one aspect of the present invention, there is provided a TiAl alloy including:

Al: 46 to 50 at %;

Mo, V and Si: a total content of these elements being limited to 5 at % or less, provided that Si content is 0.7 at % or less, and Mo content satisfies an equation of $-0.3x+17.5$ at % or less where x represents Al content (at %); and the remainder being Ti and inevitable impurities.

Each of Mo, V and Si should be included more than zero %. Mo may be replaced by Fe, or combination of Fe and Mo.

TiAl alloy is heated to a melt, poured into a mold, and cooled at a rate of 150 to 250° C./min within a temperature range of 1500 to 1100° C. From 1100 to 600° C., the melt is preferably cooled in the mold naturally or a cooling rate faster than natural since cracking would occur in the cast if it is cooled too fast and a desired structure would not result if it is cooled too slow. After 600° C., it may be cooled at an arbitrary rate.

The resulting product (cast) has additional characteristics such as improved mass productivity, creep resistance and oxidation resistance in addition to inherent characteristics of TiAl such as lightweight and high strength. Specifically, the product is fabricated by casting, which is suited for mass production. Conventionally, the product is fabricated by forging. Addition of small amount of V improves castability. It is known that the creep resistance is deteriorated when the β phase and/or coarse silicide are precipitated in the mother material during solidification. By admitting an only small amount of Mo in TiAl alloy, however, such (coarse) precipitation can be prevented. Therefore, the creep resistance is significantly improved in the TiAl alloy of the invention. Inclusion of small amount of Si improves the oxidation resistance.

By controlling the melt cooling rate to 150 to 250° C./min in a temperature range of 1500 to 1100° C., the product (as cast) has a fully or completely lamellar structure only. Accordingly, no heat treatment is required after the casting process. This contributes to reduction of a manufacturing cost.

Consequently, the product made from the TiAl of the invention by the casting method of the invention has all of the following characteristics: high strength, lightweight, high mass productivity, high creep resistance and high oxidation resistance. Since mechanical parts of a turbocharger or jet engine must have such characteristics for their liability and practicability, the TiAl alloy of the invention and the casting method are particularly suited for manufacture of the turbocharger or jet engine parts.

Although the as-cast product can be used immediately as a mechanical part, heat treatment such as HIP or homogenization may be performed later. Such heat treatment may be conducted within a temperature range of 1100 to 800° C. or $T(°\ C.) \geqq \{1200°\ C.+25(Al-44)\}+10$. The cooling rate after this heat treatment may be controlled to 100° C./min or more until room temperature.

DETAILED DESCRIPTION OF THE INVENTION

Now, embodiments of the present invention will be described in reference to the accompanying drawings.

TiAl of the present invention includes 46 to 50 at % of Al; and 5 at % or less of combination of Mo, V and Si, provided that Si is added 0.7 at % or less, and Mo is added in an amount calculated by the following equation: −0.3x+17.5 at % or less when x represents an amount of Al contained (at %), with the remainder being Ti and inevitable impurities.

A product of the present invention is made from this TiAl. Specifically, this TiAl is melt and poured into in a mold. Then, the melt is cooled at a rate of 150 to 250° C./min in a temperature range of 1500 to 1100° C. From 1100 to 600° C., it is preferably cooled in the mold naturally or at a rate faster than natural since cracking would occur in the cast if cooled too fast and a desired structure would not result if cooled too slow. The product can be used as cast.

TiAl and the resulting product have improved characteristics such as higher mass productivity, creep resistance and oxidation resistance in addition to inherent characteristics of TiAl such as lightweight and high strength. Specifically, even when the product is used as a mechanical part in a turbocharger of a diesel engine operating at a temperature of 800° C. or more for a considerable period repeatedly, no creep rupture and scale peeling would not occur. Further, after cooled to the room temperature in the mold (i.e., upon completion of the casting process), the solidified TiAl can be used immediately without heat treatment, so that the product can be manufactured in a large mass at a reduced cost. Moreover, the lightweight and high strength, which are the original characteristics of TiAl, are adversely affected little.

Now, the composition of this alloy (TiAl) and a method of casting will be described.

Figure 1:
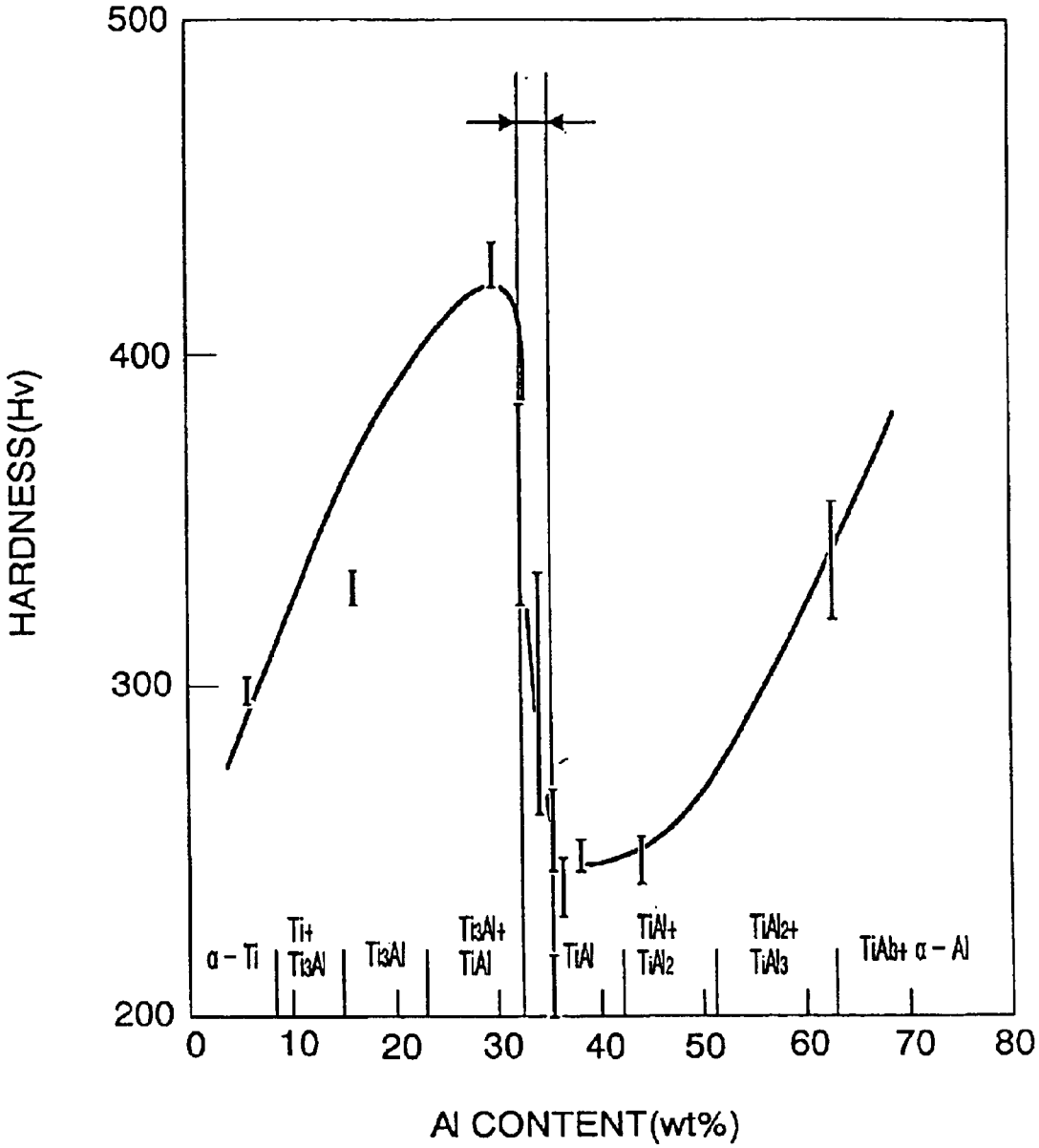
FIG. 1 is a graph illustrating relationship between an amount of Al contained, and hardness of TiAl.
Figure 2:
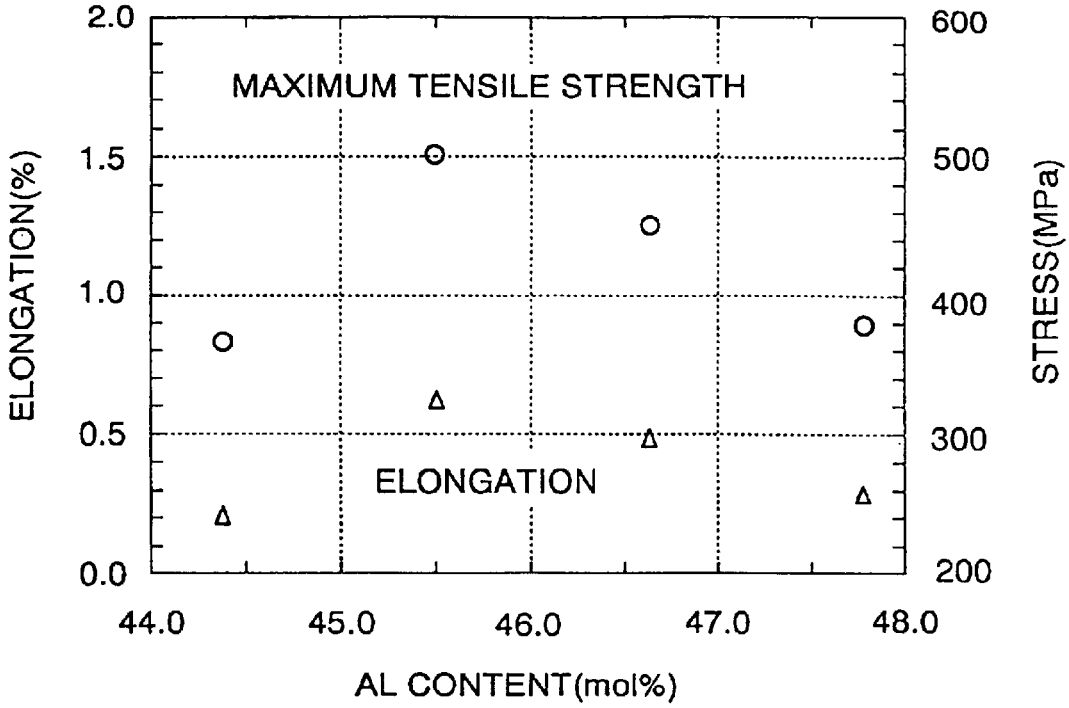
FIG. 2 is a graph showing relationship between an amount of Al contained, elongation, and stress.
Figure 3:
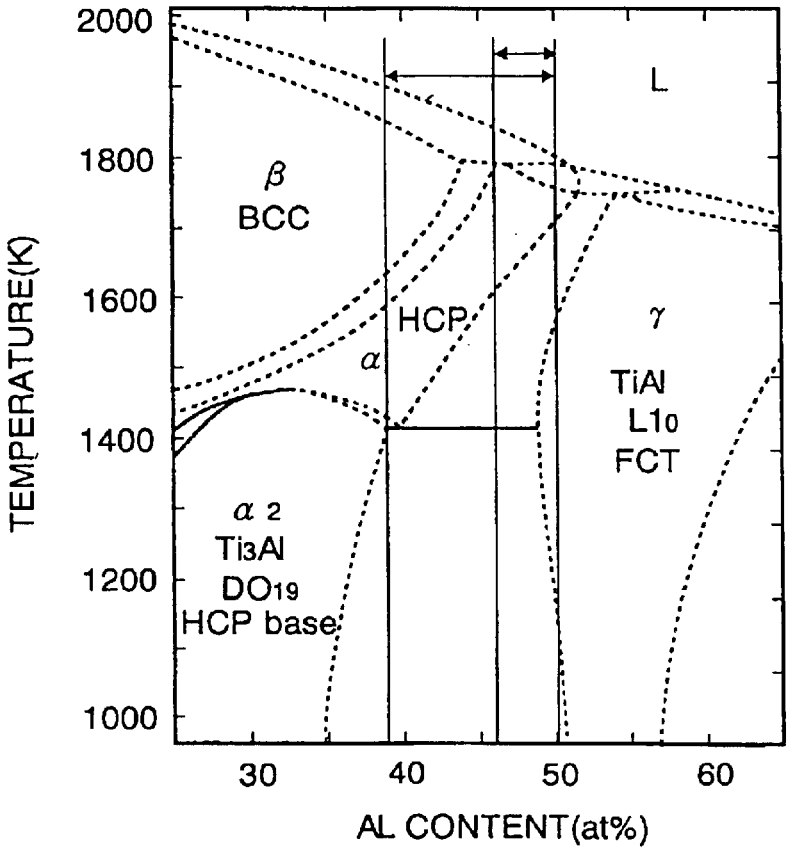
FIG. 3 is a phase diagram showing relationship between Al content and temperature.

Al content of the alloy according to the present invention should fall within a range of 46 to 50 at %. In general, the product as cast has cracking in its surface or inside due to shrinkage during solidification. In order to prevent such cracking, the product should be dehardened and possess room temperature ductility. In the case of TiAl, as shown in FIGS. 1 and 2, TiAl has sufficient room temperature ductility when Al is contained 45.5 at % or more. However, when Al is contained 45.5 at %, the oxidation resistance is low. Consequently, Al should be included at least 46 at %. In order to raise the creep resistance at high temperature, on the other hand, the cast should have a fully lamellar structure with (or constituted by) $\alpha_2$ ($Ti_3Al$) phase and $\gamma$ (TiAl) phase. This structure is obtained when Al is contained about 38 to 50 at % (see FIG. 3). In the present invention, therefore, Al content is limited to 46 to 50 at % in order to have both appropriate room temperature ductility and fully lamellar structure.

Figure 4:
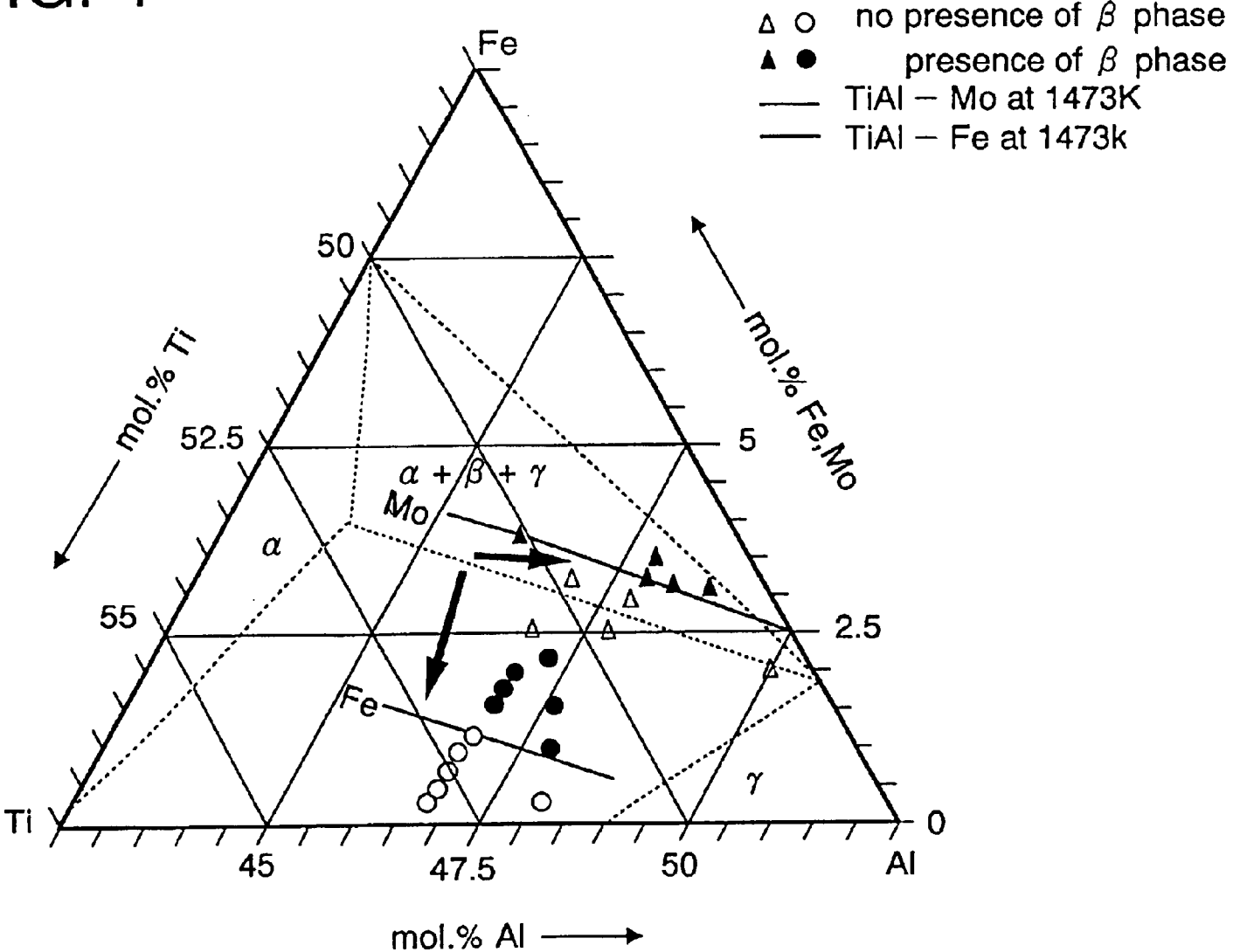
FIG. 4 is a ternary TiAl—Mo phase diagram at 1473K with comparison of ternary TiAl—Fe phase diagram.
Figure 5:
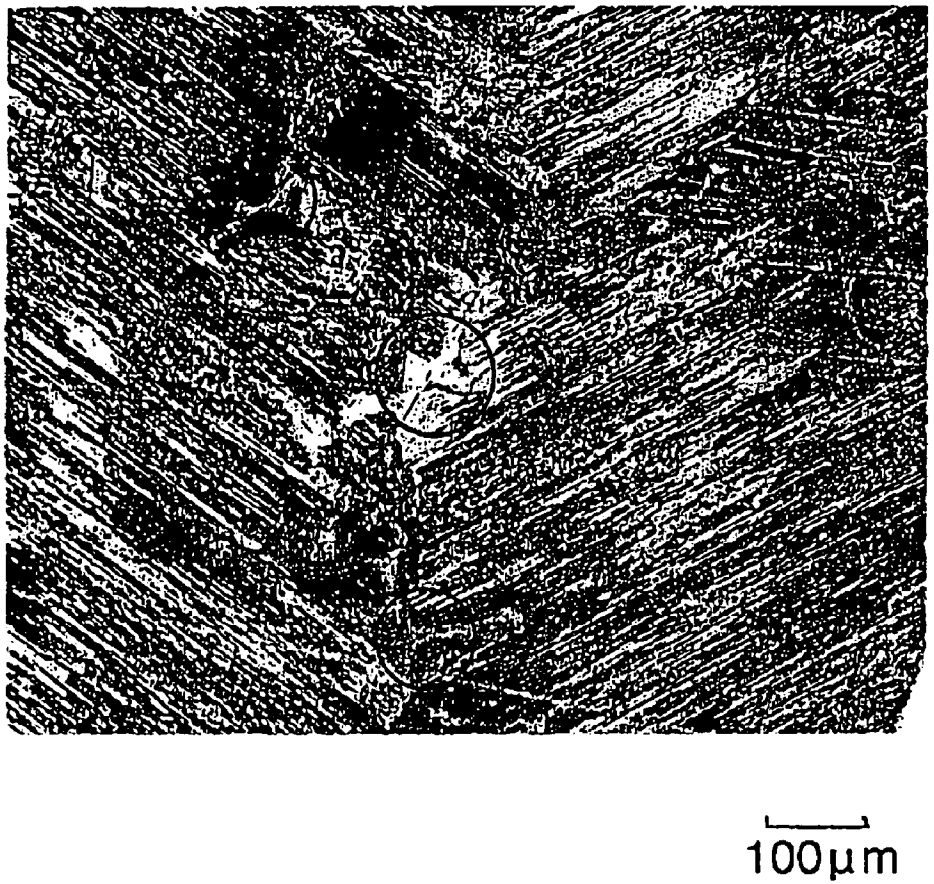
FIG. 5 is a copy of microphotograph showing precipitation of β phase on a lamellar grain boundary in a comparative example.
Figure 6:
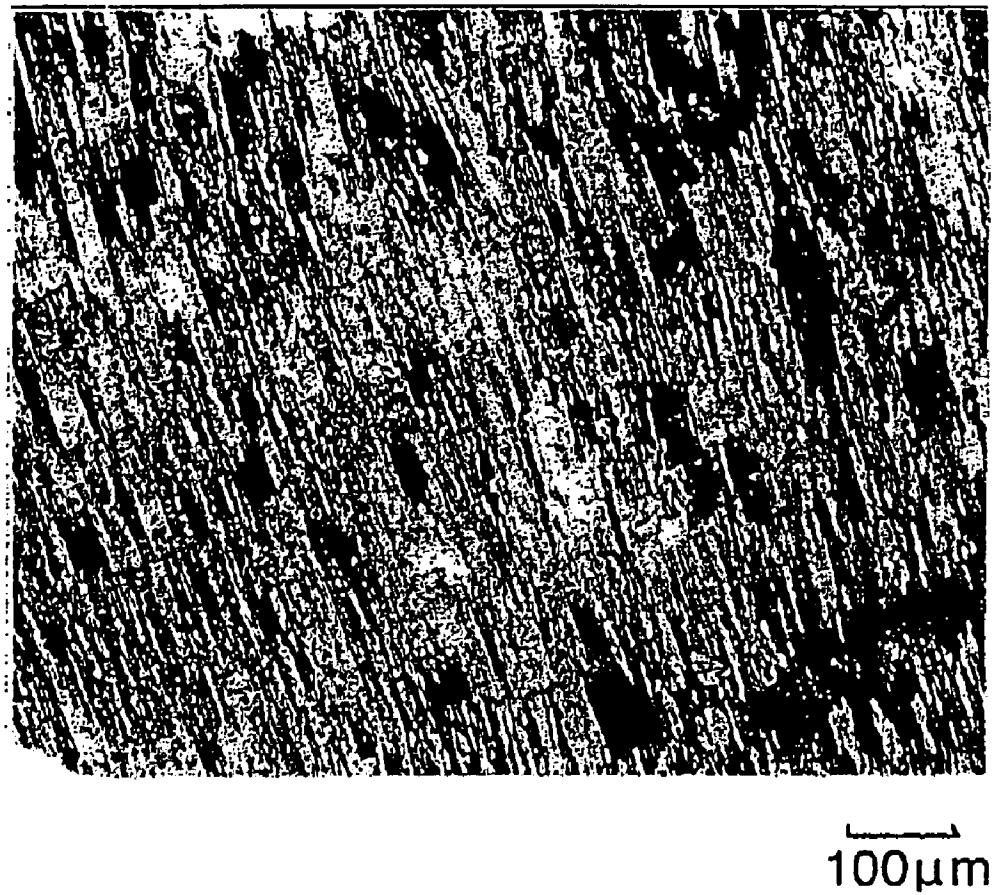
FIG. 6 is a copy of microphotograph showing a fully lamellar structure in TiAl of the present invention.

The third and fourth elements to be added are a group of Mo, V and Si, a group of Fe, V and Si, or a group of Mo, Fe, V and Si. Mo and Fe are selectively included, both or one of them. One of these three groups is included in TiAl of the invention, and the content of the group is limited to 5 at % or less. The combination of V, Si, Mo and/or Fe serves to stabilize the $\beta$ phase in the Ti alloy. In order to give the high temperature creep resistance to the TiAl cast, TiAl should possess the fully lamellar structure of $\alpha_2+\gamma$ phase without the $\beta$ phase. In particular, Fe and Mo are strong elements in terms of the $\beta$ phase stabilization. As depicted in FIGS. 4 and 5, experiments have shown that the $\beta$ phase is precipitated on the lamellar grain boundary even if Fe/Mo is added in a trace amount, when Al is included in a range of 46 to 50 at %. The resulting $\beta$ phase degrades the high temperature creep resistance. In view of these facts and further experimental results on a microstructure, the inventor concluded that the total amount of Si, V, Fe and/or Mo should be limited to 5 at % at most. The fully lamellar structure obtained under the above condition is seen in FIG. 6.

Figure 7:
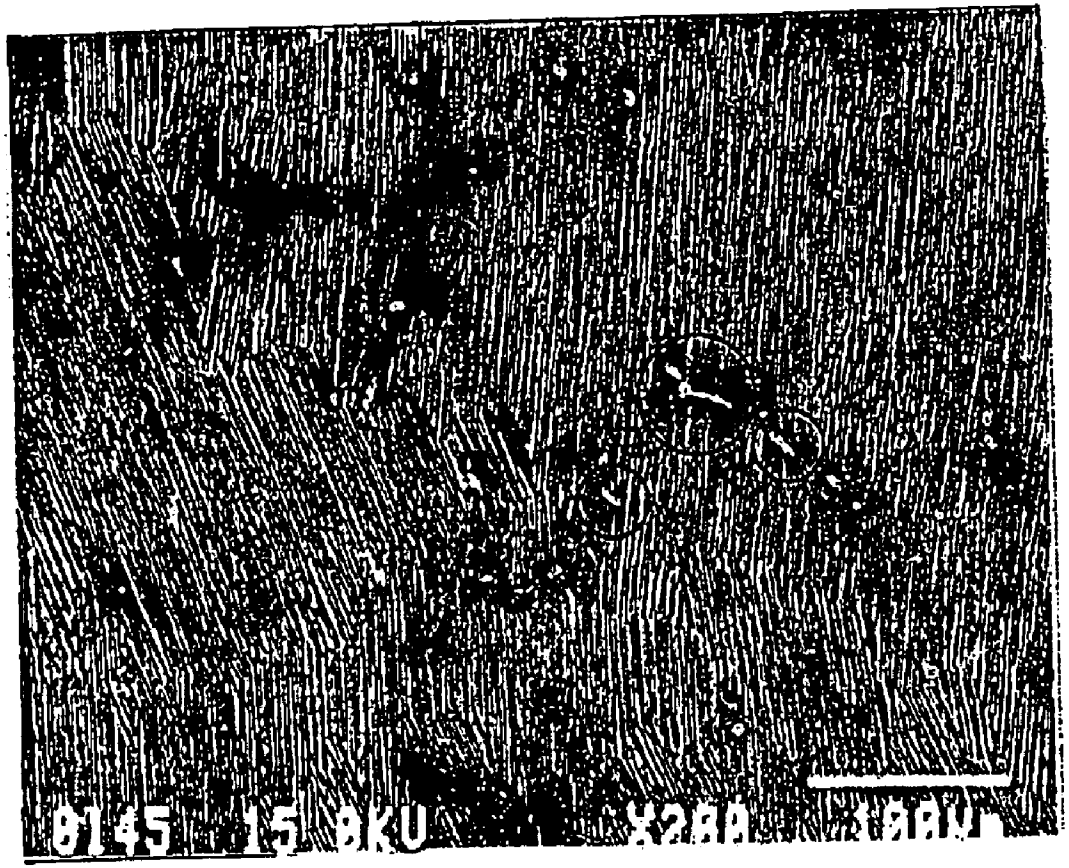
FIG. 7 is a copy of microphotograph showing precipitation of coarse silicide when Si is added more than 0.7 at %.

It should be noted here that the amount of Si should be limited to 0.7 at % or less. This is because addition of Si over 0.7 at % would result in a coarse Si compound precipitated in the lamellar structure. This would likely become an origin of fatigue failure. Such possibility is particularly undesirable to a machine having a rotating member such as turbocharger. For comparison, silicide precipitated as a result of adding Si over 0.7 at % is shown in FIG. 7.

It should also be noted that the upper limit of Mo content is determined by the following equation where x represents the amount of Al (at %): −0.3x+17.5 at %. The reason is because, as illustrated in FIG. 4, the $\beta$ phase does not precipitate if Mo is limited to such range. This is understood from the phase boundary between $\alpha+\beta+\gamma$ and $\alpha+\gamma$, as well as micro structure observation. For example, when Al content is 48 at %, the tolerable maximum value of Mo content is 3.1 at %. If Mo is included over this value, the $\beta$ phase is precipitated and the creep resistance is considerably deteriorated. It is satisfactory to substitute Fe for Mo, or further add Fe, in order to obtain the same result.

Immediately after pouring the melt of this TiAl into a mold, it is cooled at a rate of 150 to 250° C./min in a temperature range of 1500 to 1100° C. This cooling rate is important to prevent the $\beta$ phase from precipitating in the product as cast, i.e., to obtain the fully lamellar structure having a complete binary ($\alpha_2+\gamma$) phase thereby providing high creep resistance. If the cooling rate is below 150° C./min, it is not possible to obtain a lamellar structure having small layer gaps. As the Al content approaches 50 at %, $\gamma$ particles tend to appear in the lamellar structure. The slower the cooling speed, the greater mount the $\gamma$ particles precipitate. On the other hand, if the cooling rate exceeds 250° C./min, a cooling rate difference between the product surface and interior may become very large. For example, when a part of a turbocharger is prepared by the casting at the cooling rate over 250° C./min, ductility cannot follow shrinkage upon solidification. This would result in cracking upon casting. For example, when turbine parts are cast, cracking may occur in turbine vanes or their root portions.

If parts of a diesel engine turbocharger are fabricated from TiAl of the invention by the casting, the following ratio is preferred among Al, Mo (Fe), V and Si, although it is ultimately determined according to the size and operating conditions of the product: 48±1.0 at % of Al, 0.4 to 0.8 at % of Mo (Fe), 0.5 to 1.1 at % of V, and 0.1 to 0.3 at % of Si. The cooling rate is preferably maintained to 150 to 250° C./min within the temperature range of 1500 to 1100° C.

The resulting cast can be immediately used as a product (mechanical part of the turbocharger). However, there is a possibility that some deficiencies may exist in the product since it is an as-cast product which does not undergo any heat treatment. Accordingly, if desired or necessary, suitable heat treatment such as HIP(Hot Isostatic Press) or homogenization is applied to the cast to eliminate possible deficiencies.

Heat treatment conditions should be determined in such a manner not to destroy the fully lamellar structure formed in the above-mentioned cooling process. Specifically, the heat treatment is performed in a temperature range of 800 to 1100° C. Such cooling maintains the fully lamellar structure and eliminates the casting deficiencies. In order to maintain the fully lamellar structure obtained by the cooling at the rate of 150–250° C./min in the casting process after the heat treatment, the heat treatment temperature should be below about 1125° C., which is the eutectoid temperature. The inventor considered temperature variations/irregularity in industrial furnaces/ovens and concluded that the practical upper limit temperature is 1100° C. The lower limit temperature should be higher than a value at which the product is used (about 750° C.), and a value such that the homogenization or HIP effect be fairly provided by the heat treatment. After experiments, the inventor concluded that the lower limit temperature is practically 800° C.

Figure 8:
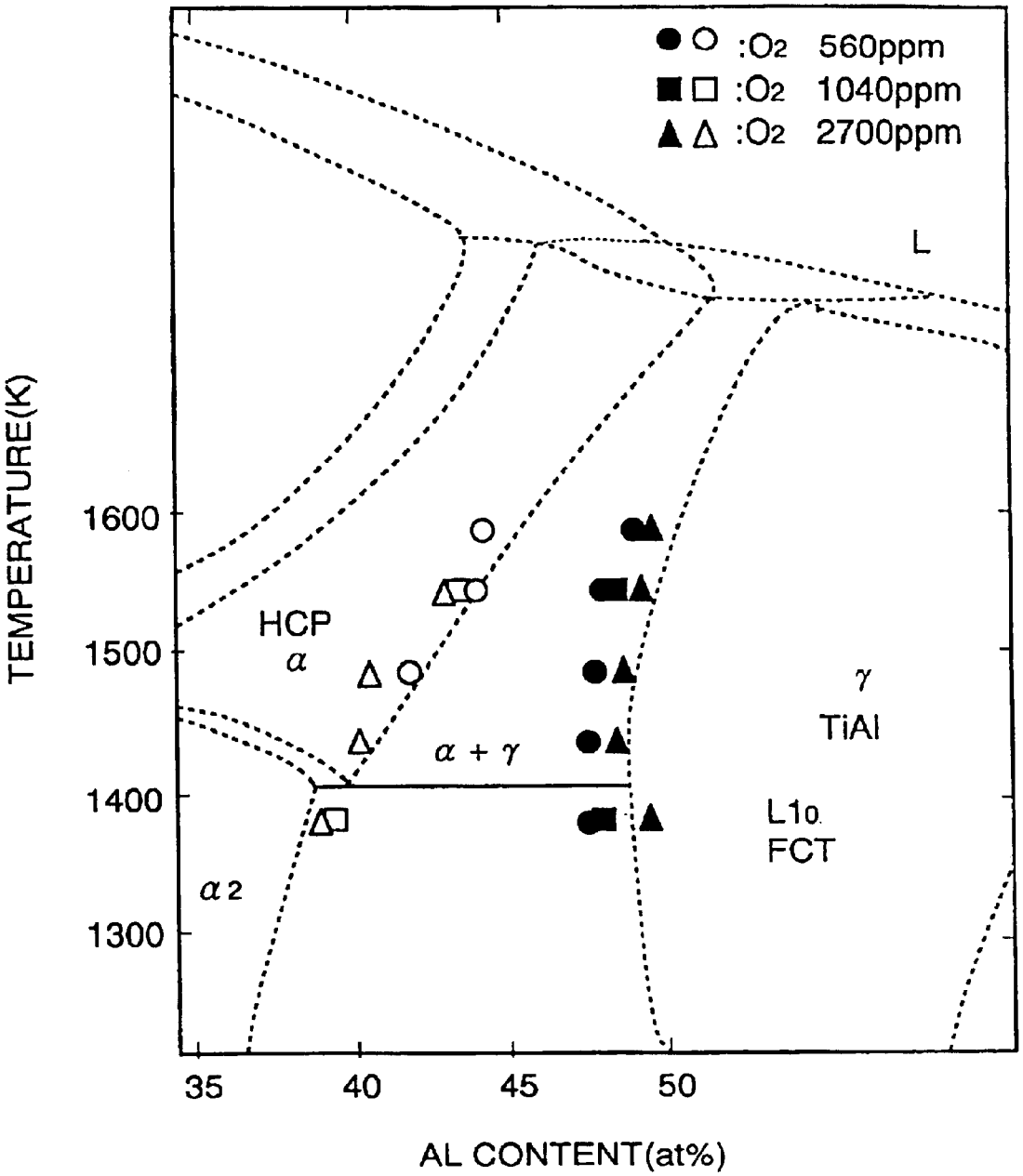
FIG. 8 illustrates a Ti—Al phase diagram.

Alternatively, the heat treatment may be conducted in a range satisfying the following equation: $T(°\ C.) \geqq \{1200°\ C. + 25(Al-44)\} + 10$. Such cooling also maintains the fully lamellar structure and eliminates the casting deficiencies. The fully lamellar structure obtained by the 150–250° C./min cooling in the casting process, which insures satisfactory creep resistance at elevated temperature, should be maintained even after the heat treatment. If the heat treatment is conducted in an area of $\alpha+\gamma$, as shown in FIG. 8, then $\gamma$ particles would precipitate. Consequently, the fully lamellar structure is not obtained. To avoid such microstructural deficiencies, it is necessary to heat the product over the $\alpha$ to $(\alpha+\gamma)$ phase transformation temperature, and the heat treatment should be performed in the pure $\alpha$ phase area. The $\alpha$ to $\alpha+\gamma$ phase transformation point depends on the Al content. As far as the TiAl alloy of the invention is concerned, the inventor found from experiments that the equation of $T(°\ C.) \geqq \{1200°\ C. + 25(Al-44)\} + 10$ is established in this regard.

After the heat treatment, the product is cooled at a rate of 100° C./min or more. If the cooling speed is set to below 100° C./min, precipitation of $\gamma$ particles is promoted when passing through the $\alpha+\gamma$ area during cooling, and layer intervals in the lamellar structure are enlarged. Such microstructural deficiencies are undesirable.

Now, examples of the present invention and comparative examples will be described.

Referring to Table I and II, prepared were 45 specimens including Al, Mo (or Fe, or Mo and Fe), V and Si with the remainder being Ti and inevitable impurities in different amounts. Each of these specimens was heated to a melt, and cooled at the cooling rate of 150 to 250° C./min within a temperature range of 1500 to 1100° C. The specimens of No. 1 to 45 were those as cast. These specimens were evaluated in terms of creep resistance, oxidation resistance and structure observation in the following manners.

Creep Resistance:

Each specimen was machined to a rod that has a parallel portion of 6 mm diameter and 30 mm length and subjected to a creep rupture test with a load of 160 to 270 MPa at a temperature of 760° C. in the atmosphere. The time to rupture (hours) was measured. Major experimental results are shown in Tables I and II as well as in FIG. 9. The values in the "Creep Rupture" columns in Tables I and II indicate those obtained when a load of 240 MPa was applied.

Oxidation Resistance:

Each specimen was heated at 800° C. for 30 minutes in a thermobalance and cooled to room temperature in 5 minutes. Then, each specimen was left alone for 20 minutes and heated to 800° C. again for 30 minutes. This cycle was repeated 200 times. One cycle needed 55 minutes. Subsequently, the weight change of the specimen was measured between before and after the test. With this result, an amount of increase in oxidation per unit area ($mg/cm^2$) was calculated. Major values obtained in this manner were shown in "Oxi. Incr." columns of Tables I and II as well as in FIG. 10.

Structure Observation:

Each specimen was cut, and the resulting (exposed) face was analyzed in terms of microstructure by an optical microscope and reflex electroimage, in order to determine presence/absence of a completely binary phase lamellar structure, i.e., fully lamellar structure. In Tables I and II, O represents existence and X represents absence.

Figure 9:
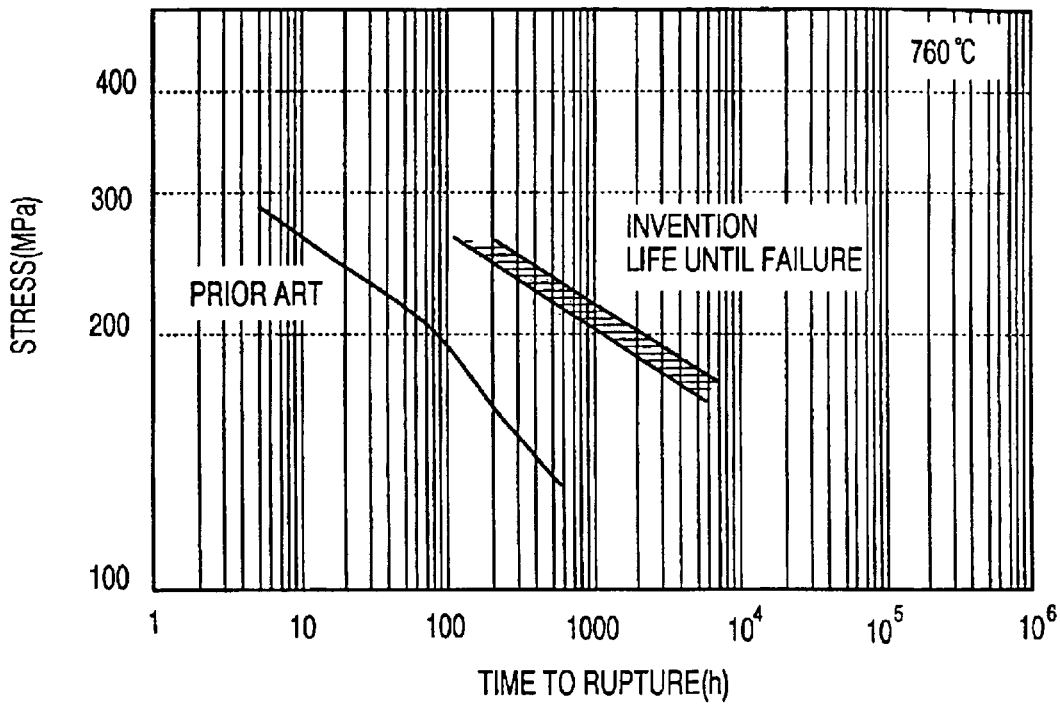
FIG. 9 illustrates results of a creep rupture test.
Figure 10:
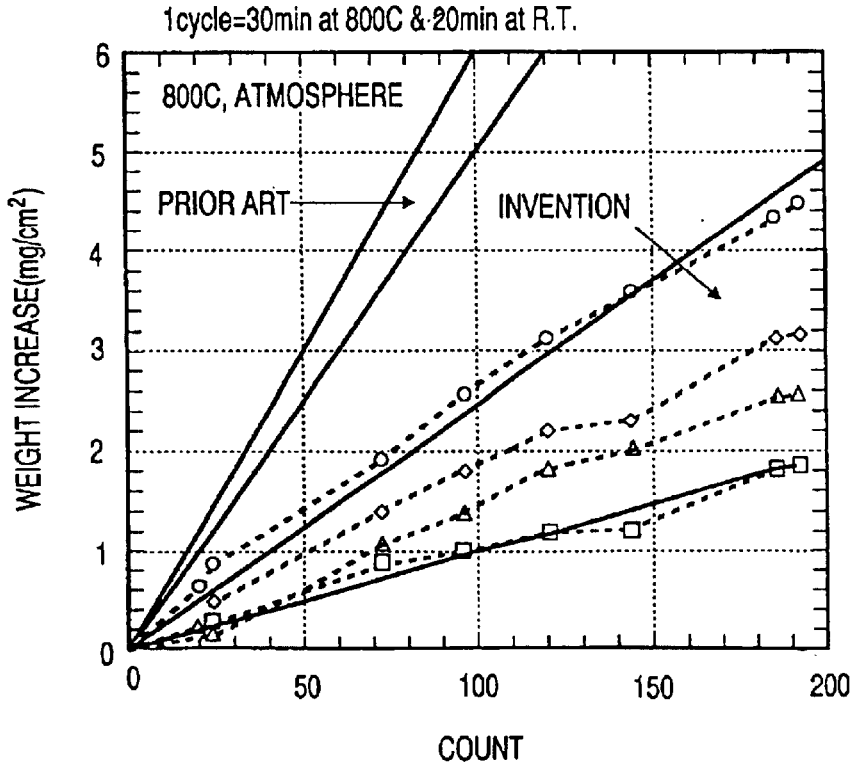
FIG. 10 illustrates high temperature oxidation property of TiAl of the invention and TiAl of the prior art.

As understood from FIG. 9, the creep resistance (life) of the invention TiAl was significantly improved (at least by one digit) over the conventional TiAl at any stress. As illustrated in FIG. 10, the increase of oxidation in the invention TiAl was considerably reduced as compared to the conventional TiAl.

As shown in Tables I, II and FIGS. 9, 10, the complete binary-phase lamellar structure could not be found in the specimens Nos 3, 5 and 7 with the total amount of Mo/Fe, V and Si exceeding 5 at %, and the specimens Nos. 10, 17, 34, 38, 43 and 45 with the sum of Mo and Fe exceeding the upper limit of the present invention. On the other hand, the fully lamellar structure was found in the specimens of the invention with the total amount of Mo/Fe, V and Si being within 5 at % and the amount of Mo being below the upper limit of the invention.

The illustrated and described TiAl is disclosed in Japanese Patent Application No. 11-161073 filed on Jun. 8, 1999, the instant application claims priority of this Japanese Patent Application, and the entire disclosure thereof is incorporated herein by reference.

TABLE I

| | Alloy Composition (at %) | | | | | | | Creep | 2-Phase Layer |
|---|---|---|---|---|---|---|---|---|---|
| Speci. No. | Al | Mo | Fe | V | Si | Ti + Imp. | Oxi. Incr. ($mg/cm^2$) | Rup-ture | Struc-ture |
| 1 | 46.0 | 3.5 | — | 0.5 | 0.5 | Re-mainder | | | ○ |
| 2 | 46.0 | 3.5 | — | 1.5 | 0.5 | Re-mainder | | | ○ |
| 3 | 46.0 | 3.5 | — | 2.5 | 0.5 | Re-mainder | | | X |
| 4 | 46.0 | 3.5 | 0.5 | 1.5 | 0.5 | Re-mainder | | | ○ |
| 5 | 46.0 | 3.5 | 1.0 | 1.5 | 0.5 | Re-mainder | | | X |
| 6 | 47.0 | 3.0 | — | 1.5 | 0.3 | Re-mainder | | | ○ |
| 7 | 47.0 | 3.0 | 0.5 | 1.5 | 0.3 | Re-mainder | | | X |
| 8 | 47.0 | — | 0.5 | 1.0 | 0.3 | Re-mainder | 4.6 | over 300 h | ○ |
| 9 | 47.0 | — | 1.0 | 1.0 | 0.3 | Re-mainder | 5.0 | over 300 h | ○ |
| 10 | 47.0 | 2.5 | 1.2 | 1.0 | 0.5 | Re-mainder | | | X |

TABLE I-continued

| Speci. No. | Alloy Composition (at %) Al | Mo | Fe | V | Si | Ti + Imp. | Oxi. Incr. (mg/cm$^2$) | Creep Rup-ture | 2-Phase Layer Struc-ture |
|---|---|---|---|---|---|---|---|---|---|
| 11 | 47.5 | 0.5 | — | 1.0 | 0.5 | Re-mainder | 3.3 | | ○ |
| 12 | 47.5 | 0.5 | — | 1.5 | 0.3 | Re-mainder | 3.4 | | ○ |
| 13 | 47.5 | 1.0 | — | 0.5 | 0.3 | Re-mainder | 2.8 | over 500 h | ○ |
| 14 | 47.5 | 1.0 | — | 1.0 | 0.3 | Re-mainder | 3.1 | over 500 h | ○ |
| 15 | 47.5 | 1.0 | — | 1.5 | 0.3 | Re-mainder | 3.4 | over 500 h | ○ |
| 16 | 47.5 | 3.0 | — | 0.5 | 0.2 | Re-mainder | | | ○ |
| 17 | 47.5 | 3.5 | — | 1.0 | 0.2 | Re-mainder | | | X |
| 18 | 48.0 | — | 0.5 | 1.0 | 0.2 | Re-mainder | 4.0 | over 400 h | ○ |
| 19 | 48.0 | — | 0.8 | 1.2 | 0.2 | Re-mainder | 4.6 | | ○ |
| 20 | 48.0 | — | 1.2 | 1.0 | 0.2 | Re-mainder | 4.8 | | ○ |
| 21 | 48.0 | 0.5 | — | 1.0 | 0.3 | Re-mainder | 2.8 | over 500 h | ○ |
| 22 | 48.0 | 0.5 | — | 1.5 | 0.3 | Re-mainder | 3.0 | over 500 h | ○ |
| 23 | 48.0 | 1.5 | — | 1.0 | 0.3 | Re-mainder | 2.0 | over 500 h | ○ |
| 24 | 48.0 | 1.5 | — | 1.5 | 0.3 | Re-mainder | | | ○ |
| 25 | 48.0 | 2.5 | — | 1.0 | 0.3 | Re-mainder | | | X |

TABLE II

| Speci. No. | Alloy Composition (at %) Al | Mo | Fe | V | Si | Ti + Imp. | Oxi. Incr. (mg/cm$^2$) | Creep Rup-ture | 2-Phase Layer Struc-ture |
|---|---|---|---|---|---|---|---|---|---|
| 26 | 48.0 | 2.5 | — | 1.0 | 0.3 | Re-mainder | | | ○ |
| 27 | 48.0 | 3.0 | — | 1.0 | 0.5 | Re-mainder | | | ○ |
| 28 | 48.0 | 3.0 | 1.0 | 1.0 | 0.5 | Re-mainder | | | X |
| 29 | 48.5 | 0.5 | — | 1.0 | 0.3 | Re-mainder | 2.8 | over 400 h | ○ |
| 30 | 48.5 | 0.5 | — | 1.0 | 0.5 | Re-mainder | 2.6 | over 400 h | ○ |
| 31 | 48.5 | 1.0 | — | 0.5 | 0.3 | Re-mainder | 2.8 | over 400 h | ○ |
| 32 | 48.5 | 1.0 | — | 0.5 | 0.5 | Re-mainder | 2.7 | over 400 h | ○ |
| 33 | 48.5 | 2.0 | — | 0.5 | 0.3 | Re-mainder | | | ○ |
| 34 | 48.5 | 3.0 | — | 0.5 | 0.5 | Re-mainder | | | X |
| 35 | 49.0 | 0.5 | — | 0.5 | 0.5 | Re-mainder | | | ○ |
| 36 | 49.0 | 1.5 | — | 0.5 | 0.5 | Re-mainder | | | ○ |
| 37 | 49.0 | 2.5 | — | 0.5 | 0.3 | Re-mainder | | | ○ |
| 38 | 49.0 | 3.0 | — | 1.2 | 0.3 | Re-mainder | | | X |
| 39 | 49.0 | — | 0.5 | 1.2 | 0.3 | Re-mainder | | | ○ |
| 40 | 49.0 | — | 0.5 | 1.2 | 0.3 | Re-mainder | | | ○ |

TABLE II-continued

| Speci. No. | Alloy Composition (at %) Al | Mo | Fe | V | Si | Ti + Imp. | Oxi. Incr. (mg/cm$^2$) | Creep Rup-ture | 2-Phase Layer Struc-ture |
|---|---|---|---|---|---|---|---|---|---|
| 41 | 50.0 | 0.5 | — | 1.5 | 0.3 | Re-mainder | | | ○ |
| 42 | 50.0 | 1.5 | — | 0.5 | 0.3 | Re-mainder | | | ○ |
| 43 | 50.0 | 2.5 | — | 1.2 | 0.3 | Re-mainder | | | X |
| 44 | 50.0 | 2.0 | 0.5 | 1.2 | 0.3 | Re-mainder | | | ○ |
| 45 | 50.0 | 2.5 | 1.0 | 1.2 | 0.3 | Re-mainder | | | X |

What is claimed is:

1. A casting method comprising the steps of:

A) preparing a TiAl alloy having the following composition:

Al: 46 to 50 at %

Mo, V and Si: each individually being present and a total of these elements being greater than 0 and less than or equal to 5 at %, provided that Si content is greater than 0 and less than or equal to 0.7 at %, and Mo content satisfies an equation of −0.3x+17.5 at % or less where x represents Al (at %), and the remainder being Ti and inevitable impurities;

B) heating the TiAl alloy to a melt;

C) pouring the melt into a mold; and

D) cooling the melt at a rate of 150 to 250° C./min within a temperature range of 1500 to 1100° C. to obtain an as-cast product.

2. A casting method comprising the steps of:

A) preparing a TiAl alloy having the following composition:

Al: 46 to 50 at %,

Fe, V and Si: a total of these elements being greater than 0 and less than or equal to 5 at %, provided that Si content is greater than 0 and less than or equal to 0.7 at %, and Fe content is greater than 0 and satisfies an equation of −0.3x+17.5 at % or less where x represents Al (at %), and the remainder being Ti and inevitable impurities;

B) heating the TiAl alloy to a melt;

C) pouring the melt into a mold; and

D) cooling the melt at a rate of 150 to 250° C./min within a temperature range of 1500 to 1100° C. to obtain an as-cast product.

3. A casting method comprising the steps of:

A) preparing a TiAl alloy having the following composition:

Al: 46 to 50 at %,

Mo, Fe, V and Si: a total of these elements being greater than 0 and less than or equal to 5 at %, provided that Si content is greater than 0 and less than or equal to 0.7 at %, the Fe content is greater than 0, and a sum of Mo and Fe satisfies an equation of −0.3x+17.5 at % or less where x represents Al (at %), and the remainder being Ti and inevitable impurities;

B)heating the TiAl alloy to a melt;

C) pouring the melt into a mold; and

D) cooling the melt at a rate of 150 to 250° C./min within a temperature range of 1500 to 1100° C. to obtain an as-cast product.

4. The casting method of claim 1 further including the step of E) heat treating the as-cast product within a temperature range of 800 to 1100° C.

5. The casting method of claim 4 further including the step of F) cooling the product at a rate of 100° C./min or more after step E.

6. The casting method of claim 1, wherein the heat treatment is HIP or homogenization.

7. The casting method of claim 2 further including the step of E) heat treating the as-cast product within a temperature range of 800 to 1100° C.

8. The casting method of claim 7 further including the step of F) cooling the product at a rate of 100° C./min or more after step E.

9. The casting method of claim 7, wherein the heat treatment is HIP or homogenization.

10. The casting method of claim 3 further including the step of E) heat treating the as-cast product within a temperature range of 800 to 1100° C.

11. The casting method of claim 10 further including the step of F) cooling the product at a rate of 100° C./min or more after step E.

12. The casting method of claim 10, wherein the heat treatment is HIP or homogenization.

13. The casting method of claim 1 further including the step of E) heat treating the as-cast product within a temperature range that satisfies the following equation:

$$T(^\circ\text{ C.}) \geqq \{1200^\circ\text{ C.}+25(\text{Al}-44)\}+10 \text{ after step D.}$$

14. The casting method of claim 13 further including the step of F) cooling the product at a rage of 100° C./min or more after step E.

15. The casting method of claim 13, wherein the heat treatment is HIP or homogenization.

16. The casting method of claim 2 further including the step of E) heat treating the as-cast product within a temperature range that satisfies the following equation:

$$T(^\circ\text{ C.}) \geqq \{1200^\circ\text{ C.}+25(\text{Al}-44)\}+10 \text{ after step D.}$$

17. The casting method of claim 16 further including the step of F) cooling the product at a rate of 100° C./min or more after step E.

18. The casting method of claim 16, wherein the heat treatment is HIP or homogenization.

19. The casting method of claim 3 further including the step of E) heat treating the as-cast product within a temperature range that satisfies the following equation:

$$T(^\circ\text{ C.}) \geqq \{1200^\circ\text{ C.}+25(\text{Al}-44)\}10 \text{ after step D.}$$

20. The casting method of claim 19 further including the step of F) cooling the product at a rate of 100° C./min or more after step E.

21. The casting method of claim 19, wherein the heat treatment is HIP or homogenization.

22. An as-cast product made by a casting method comprising the steps of:

A) preparing a TiAl alloy having the following composition:
Al: 46 to 50 at %,
Mo, V and Si: each individually being present and a total of these elements being greater than 0 and less then or equal to 5 at %, provided that
Si content is greater than 0 and less than or equal to 0.7 at %, and
Mo content satisfies an equation of −0.3x+17.5 at % or less where x represents Al (at %), and
the remainder being Ti and inevitable impurities;

B) heating the TiAl alloy to a melt;

C) pouring the melt into a mold; and

D) cooling the melt at a rate of 150 to 250° C./min within a temperature range of 1500 to 1100° C.

23. The as cast-product as claimed in claim 22, wherein the Ti—Al alloy comprises 47.0 to 49.0 at % Al, 0.4 to 0.8 at. % Mo, 0.5 to 1.1 at % V, and 0.1 to 0.3 at. % Si.

24. An as-cast product made by a casting method comprising the steps of:

A) preparing a TiAl alloy having the following composition:
Al: 46 to 50 at %,
Fe, V and Si: a total of these elements being greater than 0 and less than or equal to 5 at %, provided that Si content is greater than 0 and less than or equal to 0.7 at %, and Fe content is greater than 0 and satisfies an equation of
−0.3x+17.5 at % or less where x represents Al (at %), and
the remainder being Ti and inevitable impurities;

B) heating the TiAl alloy to a melt;

C) pouring the melt into a mold; and

D) cooling the melt at a rate of 150 to 250° C./min within a temperature range of 1500 to 1100° C.

25. The as-cast product as claimed in claim 24, wherein the Ti—Al alloy comprises 47.0 to 49.0 at. % Al, 0.4 to 0.8 at. % Fe, 0.5 to 1.1 at. % V, and 0.1 to 0.3 at. % Si.

26. An as-cast product made by a casting method comprising the steps of:

A) preparing a TiAl alloy having the following composition:
Al: 46 to 50 at %,
Mo, Fe, V and Si a total of these elements being greater than 0 and less than or equal to 5 at %, provided
that Si content is greater than 0 and less than or equal to 0.7 at %, the Fe content is greater than 0, and a sum of Mo and Fe content satisfies an equation of −0.3x+17.5 at % or less where x represents Al (at %), and the remainder being Ti and inevitable impurities;

B) heating the TiAl alloy to a melt;

C) pouring the melt into a mold; and

D) cooling the melt at a rate of 150 to 250° C./min within a temperature range of 1500 to 1100° C.

27. The as-cast product as claimed in claim 26, wherein said Ti—Al alloy comprises 47.0 to 49.0 at. % Al, 0.4 to 0.8 at. % Mo and Fe, 0.5 to 1.1 at. % V, and 0.1 to 0.3 at. % Si.

* * * * *

UNITED STATES PATENT AND TRADEMARK OFFICE

CERTIFICATE OF CORRECTION

PATENT NO. : 6,923,934 B2
DATED : August 2, 2005
INVENTOR(S) : Sadao Nishikiori

It is certified that error appears in the above-identified patent and that said Letters Patent is hereby corrected as shown below:

Column 9,
Line 52, after "Al-44)}", insert -- + -- before the numeral "10".

Column 10,
Line 6, delete "then" and insert -- than --.
Line 45, after "Mo, Fe, V and Si", insert -- : --, before "a total of".

Signed and Sealed this

Eighteenth Day of October, 2005

JON W. DUDAS
*Director of the United States Patent and Trademark Office*